US010037663B2

(12) United States Patent
Heinz et al.

(10) Patent No.: US 10,037,663 B2
(45) Date of Patent: Jul. 31, 2018

(54) ALARM DEVICE

(71) Applicant: DEUTSCHE TELEKOM AG, Bonn (DE)

(72) Inventors: Sebastian Heinz, Bonn (DE); Joerg Windheuser, Duesseldorf (DE)

(73) Assignee: DEUTSCHE TELEKOM AG, Bonn (DE)

( * ) Notice: Subject to any disclaimer, the term of this patent is extended or adjusted under 35 U.S.C. 154(b) by 0 days.

(21) Appl. No.: 15/442,735

(22) Filed: Feb. 27, 2017

(65) Prior Publication Data

US 2017/0169677 A1 Jun. 15, 2017

Related U.S. Application Data

(63) Continuation of application No. 14/770,828, filed as application No. PCT/EP2014/000485 on Feb. 25, 2014, now Pat. No. 9,734,679.

(30) Foreign Application Priority Data

Feb. 28, 2013 (DE) ..... 10 2013 003 312

(51) Int. Cl.
*G08B 13/12* (2006.01)
*G08B 13/14* (2006.01)

(52) U.S. Cl.
CPC ..... *G08B 13/1463* (2013.01); *G08B 13/12* (2013.01); *G08B 13/1445* (2013.01)

(58) Field of Classification Search
CPC . G08B 13/12; G08B 13/1463; G08B 13/1445
USPC ..... 340/568.2
See application file for complete search history.

(56) References Cited

U.S. PATENT DOCUMENTS

| | | | | |
|---|---|---|---|---|
| 6,175,310 | B1 | 1/2001 | Gott | |
| 7,426,197 | B2 | 9/2008 | Schotten et al. | |
| 8,971,673 | B2 | 3/2015 | Beinhocker | |
| 9,734,679 | B2 * | 8/2017 | Heinz | G08B 13/12 |
| 2008/0236209 | A1 | 10/2008 | Conti et al. | |
| 2010/0231388 | A1 | 9/2010 | Shute et al. | |

(Continued)

FOREIGN PATENT DOCUMENTS

| | | | |
|---|---|---|---|
| CN | 102915457 | A | 2/2013 |
| JP | H 10105837 | A | 4/1998 |

(Continued)

*Primary Examiner* — John A Tweel, Jr.
(74) *Attorney, Agent, or Firm* — Leydig, Voit & Mayer, Ltd.

(57) ABSTRACT

An alarm device includes a portable alarm emitter, the portable alarm emitter being configured to detect a change in an electrical property of a sensor element which is connected to the portable alarm emitter and to signal an alarm if a change is established. The portable alarm emitter and the sensor element are separate units configured to be interconnected with electrical contact. The portable alarm emitter is a reusable unit. The sensor element has an end which is formed as an eye through which an other end of the sensor element can be passed in order to form a closed loop which can only be made smaller because of a one-way locking function of the eye, the sensor element having at least one line element which can be contacted after the other end is introduced into the alarm emitter.

14 Claims, 6 Drawing Sheets

(56) References Cited

U.S. PATENT DOCUMENTS

| | | | | |
|---|---|---|---|---|
| 2011/0068920 | A1 | 3/2011 | Yeager et al. | |
| 2012/0050042 | A1* | 3/2012 | Shute | G08B 13/1445 340/572.1 |

FOREIGN PATENT DOCUMENTS

| | | | |
|---|---|---|---|
| JP | 2010522930 | A | 7/2010 |
| WO | WO 2010105080 | A1 | 9/2010 |

* cited by examiner

...different options for fixing the disposable material (in this case a cable tie) and releasing it again (schematic drawing)...

ALARM DEVICE

CROSS-REFERENCE TO RELATED APPLICATIONS

This patent application is a continuation of copending U.S. patent application Ser. No. 14/770,828, filed Aug. 27, 2015, which is a U.S. National Phase application under 35 U.S.C. § 371 of International Application No. PCT/EP2014/000485, filed on Feb. 25, 2014, and claims benefit to German Patent Application No. DE 10 2013 003 312.8, filed on Feb. 28, 2013, all of which applications are hereby incorporated by reference herein. The International Application was published in German on Sep. 4, 2014 as WO 2014/131505 A1 under PCT Article 21(2).

FIELD

The invention relates to an alarm device comprising a portable alarm emitter, the alarm emitter being set up to detect a change in an electrical property of a sensor element connected to the alarm emitter and to signal an alarm if a change is established.

BACKGROUND

Alarm devices are used for securing articles against unauthorised theft. For example, it is known to equip bicycle locks with an alarm device, in which case the alarm device can be carried by a user, in other words can basically be considered portable, and usually comprises a steel cable which can be fastened to the bicycle and if appropriate to an article in the vicinity. One end of a steel cable of this type is rigidly connected to the alarm emitter, whilst the other end is open, and can thus for example be guided through bicycle spokes or through the frame so as subsequently to connect this end to the alarm emitter, which thus also simultaneously has a locking function.

The primary function is to prevent theft of the secured article, such as in this case a bicycle, although embodiments are also known in the art in which the cutting of the steel cable is detected and hereafter an alarm, in particular an acoustic alarm, is triggered. To make detection of this type possible, it is known to form an electrical circuit using the steel cable mentioned at the outset, the opening of said circuit when the steel cable is cut being detected by the alarm emitter.

Alarm devices of this type are destroyed as a result of the steel cable which is formed as a sensor element being cut, in other words cannot be reused in future.

Further, alarm devices of this type, comprising sensor elements which are also intended to make theft difficult or impossible, have the drawback of a very high weight, and so, although alarm devices of this type are portable in principle, they cannot be carried comfortably by a user.

Further, a further drawback of alarm devices of this type is that they are tailored to a specific application, such as in this case making bicycle theft more difficult and providing an acoustic indication of bicycle theft, and therefore known alarm devices of this type generally cannot be used universally.

SUMMARY

In an embodiment, the present invention provides an alarm device. The alarm device includes a portable alarm emitter and a sensor element connected to the alarm emitter.

The portable alarm emitter is configured to detect a change in an electrical property of a sensor element which is connected to the portable alarm emitter and to signal an alarm if a change is established. The portable alarm emitter and the sensor element are separate units configured to be interconnected with electrical contact. The portable alarm emitter is a reusable unit. The sensor element has an end which is formed as an eye through which an other end of the sensor element can be passed in order to form a closed loop which can only be made smaller because of a one-way locking function of the eye, the sensor element having at least one line element which can be contacted after the other end is introduced into the alarm emitter.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
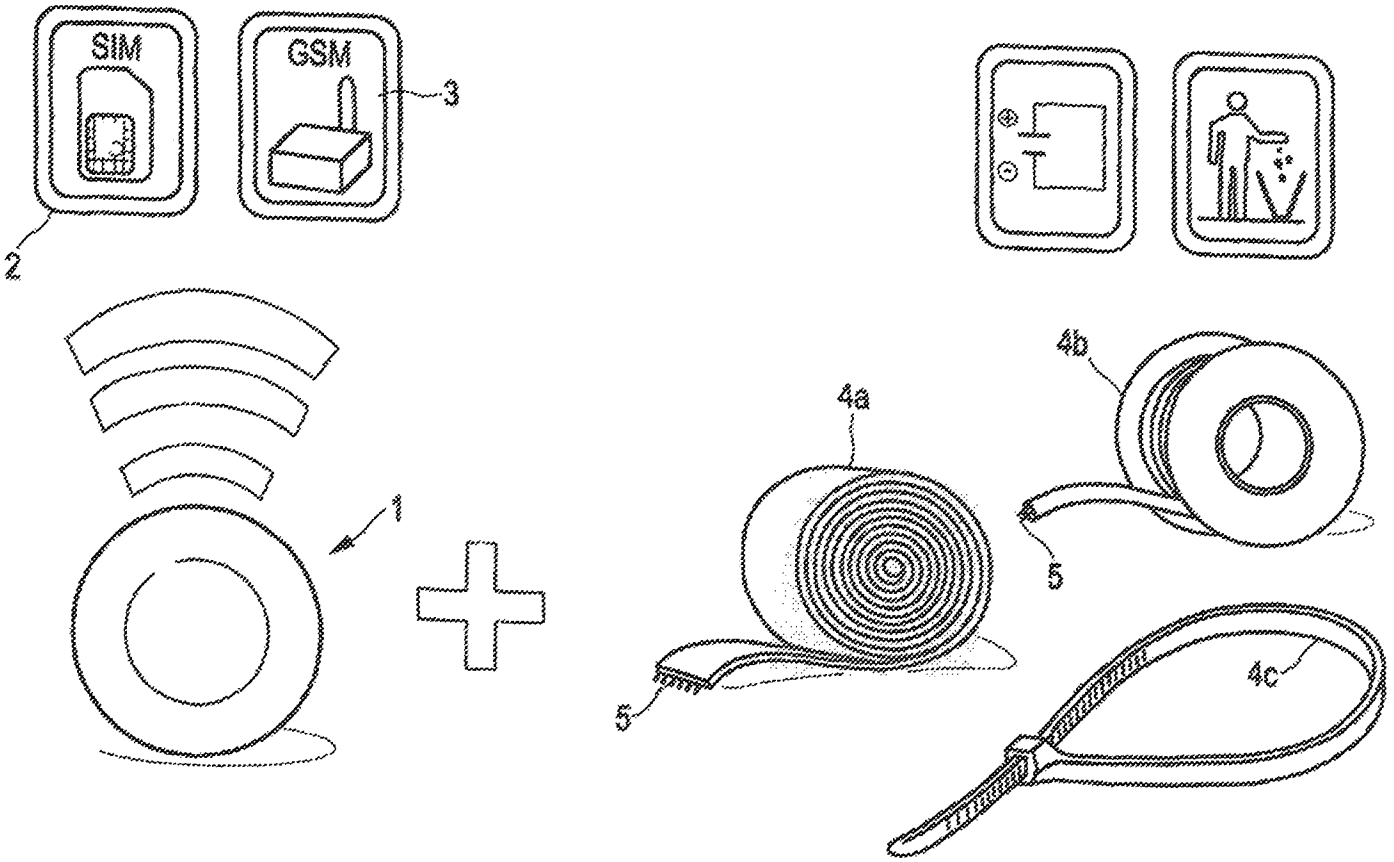
FIG. 1 is an overview of an alarm device according to the invention.

In an embodiment, the invention provides an alarm device of the type mentioned at the outset which is light, can easily be carried by people, can preferably be used universally for securing a wide range of articles, and in particular can also be used repeatedly, at least in part, when the sensor element has been destroyed.

In an embodiment, the invention provides an alarm device which is configured according to the invention to the effect that the alarm emitter and at least one sensor element each form separate units and can be interconnected with electrical contact, in particular also being connected so as to be mechanically fastened together, the alarm emitter being formed as a reusable unit and the at least one sensor element being formed as a disposable unit.

A first aspect of the invention is to form the alarm emitter and the at least one sensor element as separate units, in such a way that any destruction of the sensor element, for example by an unauthorised person or if applicable even by the authorised user, does not result in the destruction of the entire alarm device, but rather at least the alarm emitter is still useable and merely a new sensor element has to be employed for the next subsequent use.

It is provided that the alarm emitter and the at least one sensor element are interconnected with electrical contact, so as to detect the alarm situation by way of a change in an electrical property of the sensor element and to signal it accordingly.

In this context, it may be provided that in a default state between the alarm emitter and the at least one sensor element after connection of these two units with electrical contact, at least one electrical wire path, in particular at least one circuit, is closed, the opening of which, for example as a result of the sensor element being cut, is detected and signalled by the alarm emitter.

There is thus also the option of configuring sensor elements and alarm emitters in such a way that instead of at least one closed circuit or at least one closed conductor loop being opened, the reverse situation, in other words at least one open circuit, is considered the normal state, and the closing of at least one circuit is represented and detected by way of an action at the sensor element, such as movement, touching or stretching, and is signalled by the alarm emitter.

In yet another embodiment, it may be provided not merely to check the presence of an open or closed circuit as an electrical property in which a change is checked, but instead to check the resistance of a circuit, which can be changed for example by manipulative actions on the sensor element, for example by cutting, causing the resistance to become high, by closing, causing the resistance to become low, or by a change in resistance, in particular between these extremes, causing an original resistance, in particular established when the connection between the alarm emitter and the sensor element is produced, to change.

In this case too, a change may occur for example as a result of stretching, squeezing, bending, touching, or else as a result of the sensor element becoming moist or drying out, and so state changes of this type may be detected indirectly by way of a resistance of this type. There is the possibility in the case of a sensor element of detecting humidity changes by way of an electrical measurement variable other than the resistance.

The alarm emitter monitors an electrical measurement variable for a change in the at least one sensor element connected thereto, which change is brought about by manipulation at the sensor element.

According to the invention, forming a sensor element as a disposable unit at least means that a sensor element of this type cannot be indefinitely or constantly reused after in particular a first use, in other words connection to an alarm emitter and/or an article to be secured/monitored, but rather at most allows repeated use a limited number of times, whereas a preferred embodiment of the alarm device according to the invention may provide that the at least one sensor element is formed as a single-use unit, in particular one which is used up by the process of securing and unsecuring an article to be protected or else is used up by an alarm situation which has occurred.

In this context, securing an article at least comprises attaching the sensor element to an article, and preferably also simultaneously connecting (electrically and mechanically) to the alarm emitter.

Thus, a sensor element of this type may be used once so as to connect it to the article and preferably to the alarm emitter, causing an electrical contact between the sensor element and the alarm emitter to be closed and a change in an electrical property to be detectable by the alarm emitter as disclosed previously.

By contrast, if a sensor element is removed from the article to be protected or is cut, or the connection between the sensor element and the alarm emitter is released when the article to be protected is unsecured, it may preferably be provided according to the invention that the same previously used sensor element cannot be connected to the alarm emitter again and thus cannot be used again, at least not whilst restoring the functionality thereof.

However, an embodiment may also provide that it is possible to reuse a sensor element if it remains attached to the article to be secured/monitored and merely the connection between the sensor element and the alarm emitter has been released. It is only used up when it is released from the article, in particular because it can only be released by mechanical or electrical destruction, for example by tearing or cutting apart.

It may for example also be provided that once a connection has been produced between the alarm emitter and the sensor element, it cannot be separated from the alarm emitter or from an article to be protected or monitored again without an event which uses up the sensor element, such as (electrical and/or mechanical) destruction of the sensor element.

Whilst the formation of a sensor element as a single-use unit may be provided, it is not compulsory for the configuration according to the invention of an alarm device, a preferred embodiment of the invention provides, irrespective of the specific embodiment of the disposable unit, that the alarm device comprises a reserve of sensor elements from which or of which at least a single sensor element can be taken for connection to the alarm emitter.

In this way too, it is taken into account that because of the existing reserve, a user can still always use new sensor elements so as to employ the alarm emitter again to secure any desired article.

Further, it may also be provided to provide sensor elements of various types as a reserve, for example in the manner of an assortment, so as to allow different measures for attaching a sensor element to an article to be protected or monitored.

For example, sensor elements may be provided which can be connected particularly well to planar articles, for example adhesively to the surface thereof, or else sensor elements which can be positioned around articles particularly well, such as strip-shaped sensor elements.

One option for forming a reserve may provide that a reserve of this type comprises a plurality of at least similar, in particular actually identical, individual sensor elements, and accordingly in each case at least one of said sensor elements can be taken from this reserve for use with the alarm emitter and employed by connection thereof to the alarm emitter.

In this case, "similar" preferably means that the individual sensor elements have the same mode of operation as regards attachment to an article and change in an electrical property, as is the case for example for strip-shaped elements, which may however be present in the reserve in different lengths and are thus not identical, because of the different lengths, but are at least similar.

Another embodiment may provide that a reserve is formed by a coil of sensor element material, in particular by "continuous" sensor element material, in such a way that the option is used of cutting a portion of the sensor element material to length from a coil of this type, the material piece which is cut to length forming a sensor element for use in connection with the alarm emitter. This also has the advantage that if required, different lengths of sensor elements can be drawn from a coil of this type.

In the simplest case, a coil of this type may be a type of cable drum, from which a cable comprising at least one electrically conductive line is cut to a desired length so as to connect this cable or the at least one line thereof to the alarm emitter.

In this case too, it may be provided that a coil of this type is formed by a sensor element material which is adhesive at least one on side, in such a way that self-adhesive sensor elements are thus provided, which a user can attach adhesively in a simple manner to articles to be protected, in particular to articles which are not supposed to move with respect to other articles, as is the case for example for doors which are to be kept shut, in such a way that any movement of this type which does take place can be detected by way of tearing of the sensor element which is adhesively fastened to the article to be secured. In this case too, a self-adhesive sensor element of this type may comprise at least one electrically conductive line.

As already mentioned at the outset, by way of example and preferably for the invention, a sensor element may be formed so as to be strip-shaped, it being possible to provide either that a sensor element of this type is formed directly by an electrical line itself, thus in particular by a cable, or that in a preferred embodiment a sensor element of this type comprises at least one electrical line which can be electrically contacted by the alarm emitter. Preferably, for a strip-shaped sensor element, this at least one electrical line extends along the longitudinal extension direction of the strip-shaped sensor element.

In this context, various embodiments are conceivable, for example that the at least one electrical line is enclosed by the material of the sensor element and contact of this at least one electrical line by the alarm emitter at least at one end of the sensor element is made possible, for example in that the ends of the at least one electrical line of a sensor element are brought to the surface at at least one strip end of the sensor element, optionally at both strip ends, and are thus freely accessible there, or the ends are free from the material of the sensor element which encloses the at least one line and thus the at least one line is exposed there.

Alternatively, in this context it may also be provided that the at least one electrical line is embedded inside a strip-shaped sensor element according to the invention over the entire length of the sensor element and thus even at the ends, and is thus fully insulated inside the sensor element, and a connection with electrical contact between the sensor element and the alarm emitter is provided in that the material of the sensor element is penetrated at least in part by contacts of the alarm emitter at the site of the connection, so as to achieve an electrical connection through the material to the at least one electrical line arranged therein.

Another embodiment may also provide that at least one electrical line, in particular one which extends in the longitudinal extension direction of the strip-shaped sensor element, is arranged on the surface of the sensor element.

In particular an embodiment in which a sensor element is formed by an adhesive strip or comprises a surface which is adhesive at least one on side, but also in the case of other sensor elements according to the invention, may provide that at least two electrical lines are arranged on the surface in the longitudinal extension direction of the sensor element in such a way that by folding this sensor element onto itself, the electrical lines positioned in the surface can be made to cross one another and electrical contact between the lines can thus be closed.

It can accordingly be provided that for example a sensor element configured as an adhesive strip comprises two parallel electrical lines positioned on the surface of the adhesive strip, for example on the adhesive surface of the adhesive strip, in such a way that, at one end of a sensor element of this type in the form of an adhesive strip, the connection thereof to the alarm emitter can be provided, for which purpose it contacts each of the two lines, the aforementioned crossing of the electrical lines further being achieved at the other end of the adhesive strip by folding it onto itself, in such a way that overall, a closed circuit is provided between the alarm emitter and the two electrical lines of the adhesive strip.

Tearing through the adhesive strip, which is adhesively fastened for example to an article to be secured, such as a door leaf and a door frame, accordingly leads to the adhesive strip tearing apart and to at least one of the electrical lines breaking, and this may be detected and signalled accordingly by the alarm emitter.

Naturally, there is the option of also providing a plurality, i.e. in particular more than two, electrical lines inside a strip-shaped sensor element of this type, which lines can be electrically connected to at least two corresponding contact elements on the alarm emitter, preferably to a corresponding number of contacts on the alarm emitter, so as to be able to establish any changes in an electrical property by way of the alarm emitter.

In addition to the electrical contact between at least one sensor element and the alarm emitter, the connection therebetween also always results in them being mechanically fastened together.

For the connection between the alarm emitter and the sensor element, it is generally provided that the alarm emitter comprises at least one receiving region in which a sensor element can be connected to the alarm emitter with electrical contact. This may be a plug-in contact, a surface contact, or even a piercing contact in which a contact element pierces through the sensor element material enclosing an electrical line. In particular by way of a piercing contact of this type, mechanical fastening is also simultaneously provided.

In this context, a preferred embodiment may also provide that an alarm emitter comprises at least two receiving regions which are set up to connect different sensor elements. Thus for example sensor elements configured as an adhesive strip can be connected to the alarm emitter in a specific receiving region provided for this purpose, whereas other types of sensor elements, for example strip-shaped sensor elements which are laid in a loop, can be connected to the alarm emitter in another receiving region.

Naturally, there is also the option for an alarm emitter to comprise in particular at least two identical receiving regions for a sensor element which is to be used, each end thereof being introduced into a respective one of these receiving regions so as to achieve a connection with electrical contact between the sensor element and the alarm emitter.

For example, it may be provided that a receiving region is formed as an opening, for example a slot-shaped opening, into which at least one end of a sensor element can be inserted to produce a connection with electrical contact, in particular whilst also producing a mechanical connection.

In this embodiment, a sliding contact may for example be provided in the opening, and comes into connection with a surface contact region of a sensor element when an end of the sensor element is inserted, and thus produces an electrical connection to the sensor element. In this context, it may also be provided to arrange two mutually opposing electrical contacts in an opening of this type, between which an open end or even both open ends of a strip-shaped sensor element are introduced, in particular of a sensor element which comprises at least one electrical line, in such a way that by way thereof, an overall closed circuit can be produced between the alarm emitter and the sensor element.

In this context, it may be provided that an electrical line, apart from the respective end regions, is guided inside, in other words is insulated in, the strip-shaped sensor element, and in the end regions, the electrical line is brought to the surface of the sensor element, in particular at the two opposing ends, also on opposing surface faces of the sensor element, in such a way that for example a contact element is positioned on the surface at one end of the sensor element and on the lower face at another end, facilitating contact with the two loop contacts which are arranged so as to be mutually opposing after loop formation of the sensor element and insertion into the opening of the alarm emitter, in particular if the two ends are positioned one on top of the other, and the contact elements are thus arranged on faces facing away from one another.

It may also be provided that at least one end of a sensor element is introduced into an opening of a receiving region of the alarm emitter and a piercing contact is moved and pierced through the sensor element material, by an internal mechanism of the alarm emitter, in particular after mechanical actuation of a corresponding actuation element of the alarm emitter, so as to contact a sensor element or the electrical line positioned therein.

It may also be provided that a receiving region is formed as an insertion region, which is formed between two housing parts of the alarm emitter which are pivotable with respect to one another, for example foldable about an axis, and into which at least one end of a sensor element can be inserted after pivoting open the housing parts, and which is electrically contactable, and in particular also mechanically fastenable, by pivoting closed.

For example, an embodiment of this type may be provided with an insertion region if a sensor element formed as an adhesive strip, in particular a strip which is adhesive on one side, is used. In this context, it may be provided that at least one, preferably two contact elements are provided in the insertion region, so as to produce at least one electrical connection to the at least one, preferably two electrical lines inside or on the surface of the sensor element.

As regards the alarm device according to the invention, it should further be noted that in a possible variant, the sensor elements used therewith do not themselves form an active protection of an article to be secured, in particular accordingly making any theft of the article to be secured or movement of the article to be secured difficult, but are exclusively provided to detect an undesired event of this type as reliably and promptly as possible.

It may accordingly be provided that sensor elements of the type according to the invention are actually particularly easy to destroy, or in other words a change in the electrical property of a sensor element of this type, for example tearing of at least one electrical line arranged therein or thereon, is induced particularly easily by the slightest mechanical load. This is the case in particular in the variant in which the sensor element is formed as a strip which is adhesive at least on one side having at least one electrical conductor positioned therein or thereon.

A preferred embodiment of the alarm device according to the invention may provide that an alarm device of this type comprises a communication module by means of which at least if an alarm is triggered, a message signalling the alarm can be sent to a communication device, in particular a mobile telephone.

In this context, it may for example be provided that a user can store their mobile telephone number in the alarm device according to the invention, so as to establish that in the alarm situation, the user receives a message, for example a text or e-mail or other notification, to their mobile telephone, and thus becomes aware of the alarm situation, even if they are not within hearing range or visual range of the alarm emitter, and accordingly cannot perceive any acoustic or visual signalling of the alarm state.

It may also be provided to convey messages other than the simple alarm triggering to a communication device, for example status reports relating to the default state of the alarm device.

In this context, the invention may provide that an alarm device, in particular the alarm emitter, can receive a SIM card of any desired mobile network operator, so as to provide communication functionality with the communication module, it being possible for the user to determine via which telecommunications provider the messages are sent.

By contrast, it may also be provided that the communication module of the alarm device already has a permanently built-in SIM card functionality, and is thus already linked to a particular provider by the manufacturer, and when a user purchases an alarm device according to the invention of this type, they also simultaneously purchase the use of the alarm device via the telecommunications network of the corresponding provider.

In this context, it may also be provided that the alarm emitter is set up merely to make it possible to send or even receive messages via the communication module for a limited time period or a limited number of communications, in such a way that when the time period elapses or the limited number of communications has been carried out, the alarm emitter is automatically turned off, and either it has to be replaced or else the usage time period has to be extended or the number of available communications has to be increased, for example by purchasing a further usage duration or number of communications.

In this context, one embodiment of the invention may also provide that an alarm emitter can be deactivated by a message communicated to the alarm emitter and received by the communication module. Thus for example there is the option to allow third parties to use an article secured by an alarm device according to the invention, even remotely, by sending a corresponding message to the alarm emitter, even if the owner of the alarm device is not present.

Likewise, the authorised owner of an alarm device of this type can deactivate the alarm device if they are carrying their mobile telephone and send a corresponding message to the communication module of the alarm device.

In this context, an application which is executable on a mobile telephone, in particular a smartphone, may be provided, so as to exchange communication messages with the alarm emitter, in particular for the purpose of activation, deactivation or other reports, for example a status report relating to the usage period etc.

The alarm emitter may further, in particular on the surface thereof, preferably the surface of a pivotable housing part, comprise at least one actuation element, in particular at least one key, by means of which the alarm emitter can be activated and/or deactivated. Therefore, a further embodiment may also provide that the alarm device according to the invention can also be deactivated at the alarm emitter itself, for example by inputting a PIN, pressing a particular key sequence, using a lock which can be actuated with a key, or using other measures known per se in the prior art.

In this context, activation preferably means that the alarm emitter starts to check the electrical property of the sensor element for a change and in the event of a change also to signal it. In this context, it may be provided that the alarm emitter initially detects an initial state of the electrical property and saves it as a desired state for the normal situation, so as to be able to detect changes starting therefrom. Deactivation or unsecuring preferably means ending the aforementioned monitoring, thus not triggering or signalling an alarm situation in the event of a subsequently occurring change.

It is also possible, by using a key of this type or by pivoting two housing parts of the alarm emitter with respect to one another, to bring about the mechanical fastening between the sensor element and the alarm emitter or the release of the connection. In particular if pivoting of two housing parts is provided for the purpose of electrically and/or mechanically connecting the alarm emitter and the sensor element, it may be provided that, in the event of pivoting which leads to the closed state of the alarm emitter, the alarm emitter is also activated automatically without any further action being required.

An embodiment may also provide that the alarm emitter comprises, in particular on the surface thereof, preferably the surface of a pivotable housing part, at least one illumination device, in particular one by means of which an alarm can be optically signalled and/or an optical confirmation can be displayed to the user to confirm an action carried out, in particular activation or deactivation, and/or continuous or intermittent illumination can be provided. The illumination may be used for example for illuminating a person in road traffic if they are carrying the alarm device.

One embodiment may also provide that the alarm emitter comprises a localisation device, for example a GPS receiver, it being possible in particular for the detected location coordinates to be sent to a receiving communication device, for example a mobile telephone or also a computer, via a provided communication module. Thus, if the alarm emitter is stolen, it can be located and recovered. It may also be provided that the alarm emitter signals an alarm by way of the above-described options if it establishes that it has been moved, thus in particular if the coordinates thereof which are stored upon activation change.

An embodiment may also provide making the alarm emitter waterproof, so as also to make use possible outdoors, in other words under environmental influences and in particular in various weather conditions. In this context, in particular the receiving regions or the openings thereof for introducing sensor elements may be sealed.

Embodiments of the invention are described in the following.

FIG. 1 is an overview of an alarm device according to the invention, which in this case comprises an alarm emitter 1, which is for example formed as a portable unit, comprising a housing, in this case shown as having a circular cross section, the invention not being limited to the housing shape shown. Inserting a SIM card 2 gives the alarm emitter 1 the functionality whereby any alarm situation detected by the alarm emitter is communicated via the GSM mobile communications network 3 to a communication device (not shown), for example a mobile telephone of the authorised user.

According to the invention, the alarm device is not merely formed by the portable alarm emitter 1, but further comprises at least one reserve of sensor elements formed as single-use units, FIG. 1 showing that in this embodiment there are three different types of sensor elements 4*a*, 4*b* and 4*c*. In this context, the sensor elements 4*a*, 4*b* are formed as a spool reserve and accordingly form a substantially continuous supply of sensor elements, aside from the limitation due to the spool amount.

In this context, a sensor element 4*a* is formed for example by an adhesive strip comprising at least one electrical conductor, in this case symbolically six electrical conductors 5. A piece of adhesive strip can be torn or cut off from the spool reserve so as to connect the sensor element thus formed to the alarm emitter and thus to close an electrical circuit between the alarm emitter and the sensor element, it being possible to fasten the sensor element formed as an adhesive strip to any desired article.

In this context, a sensor element may also for example be formed by cable strands 4*b*, which can also be drawn from a spool reserve at a desired length. In the embodiment shown here, two electrical conductors 5 are provided in the cable sheathing, and can be connected to the alarm emitter 1 to close at least one electrical circuit, at least once the conductors 5 have been interconnected outside the alarm emitter 1 at the other end of a sensor element 4*b* of this type or once this end is likewise connected to the alarm emitter 1.

A sensor element in accordance with the embodiment 4*c* may for example have the mechanical design of a cable tie, in which it is provided that an end of this sensor element formed as an eye is passed through by the other end, and a closed loop is thus formed which can only be made smaller because of the one-way locking function of the eye. In this context, it can be provided that at least one line element (not shown) is additionally arranged in a sensor element of this type, and is contacted after the open end (without the eye) is introduced into the alarm emitter 1, for example by contacts in the alarm emitter 1 which touch corresponding contacts on the surface of the sensor element end if the at least one line element is guided inside the sensor element 4*c* on the surface thereof at the open end. The material of the sensor element can also be pierced using at least one piercing contact in the alarm emitter, so as to contact at least one line embedded therein.

For all of the different embodiments 4*a*, 4*b*, 4*c*, as well as other embodiments of sensor elements which are not shown, these sensor elements are formed as disposable units, and are thus thrown away after use, in particular after the article to be protected is unsecured, and a new sensor element is used, for example by taking it from a reserve.

Figure 2:
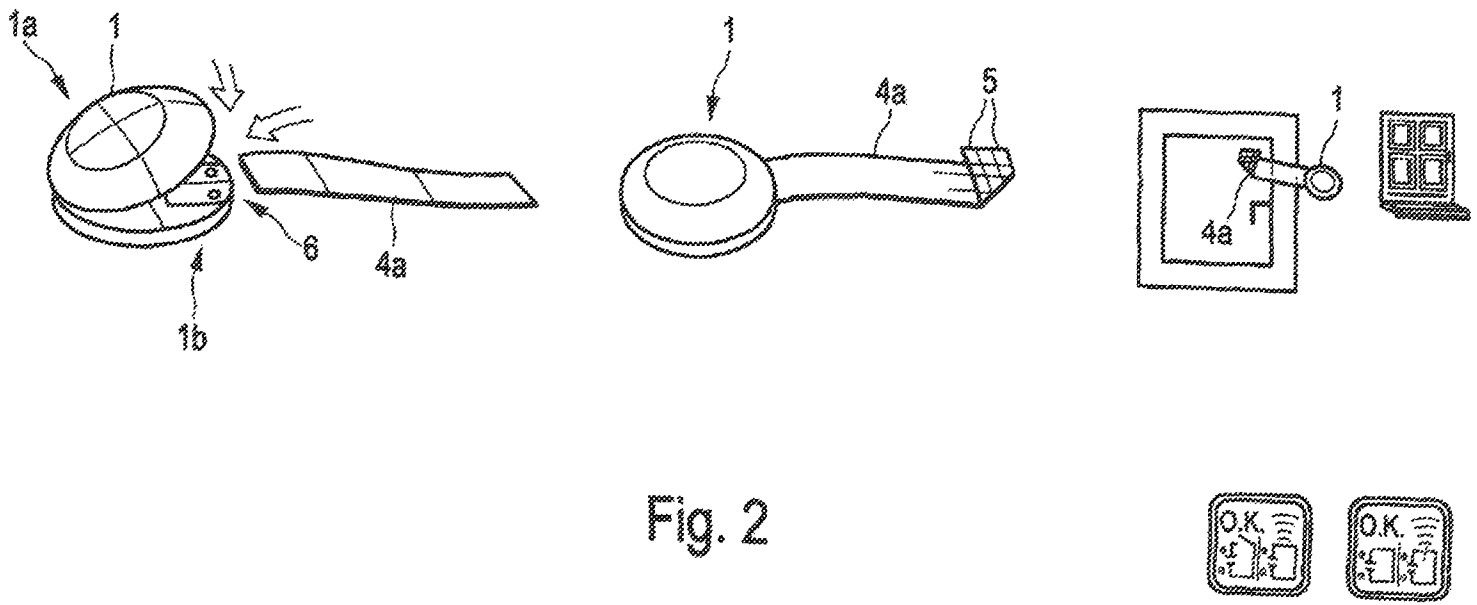
FIG. 2 illustrates a use of a sensor element.

FIG. 2 illustrates a use of a sensor element, which is formed as a strip 4*a* which is adhesive on one side and which in the present case comprises two conductors 5, which are arranged in the longitudinal extension direction and in parallel with one another in the adhesive strip or in a preferred embodiment on a surface of the adhesive strip, in particular on the adhesive surface.

The left side of FIG. 2 shows a piece of adhesive strip 4*a* cut off from a reserve, before it is introduced into and connected to the alarm emitter 1. The configuration according to the invention provides that the alarm emitter comprises two housing parts, specifically an upper housing part 1*a* and a lower housing part 1*b*, which are pivotable with respect to one another, for example about a hinge axis, causing a receiving region 6 to be released, which in the present case comprises two contacts which are arranged at the same distance which is also provided between the electrical conductors 5 of the adhesive strip.

In this context, the adhesive strip is laid in the receiving region 6 with the adhesive side, and thus also with the conductors arranged in the adhesive side, pointing downwards, and after this the two housing regions are pivoted towards one another and the receiving region 6 is thus closed in such a way that the electrical connection between the alarm emitter 1 and the sensor element 4*a* is provided.

The central part of FIG. 2 shows that the as yet open end of the adhesive strip can be folded through 45 degrees and thus onto itself, so as to achieve crossing of the two parallel conductors and thus produce a closed circuit between the two parallel conductors 5 and the alarm emitter 1.

The right side of FIG. 2 illustrates a possible field of use, specifically in this case by way of example securing a door or a window, this being achieved in that the sensor element 4*a* configured as an adhesive strip is adhered by the adhesive surface thereof over the door leaf and doorframe or window casement and window frame, in such a way that it is only possible to open the door or window if the sensor element 4*a* is torn apart in the process, and the closed electrical circuit between the conductors 5 is thus opened and as a result the alarm situation is detected by means of the alarm emitter 1. Said alarm emitter can subsequently signal this alarm situation, for example acoustically and/or optically and/or by sending out a message by means of a communication module to a telecommunications device (not shown).

Figure 3:
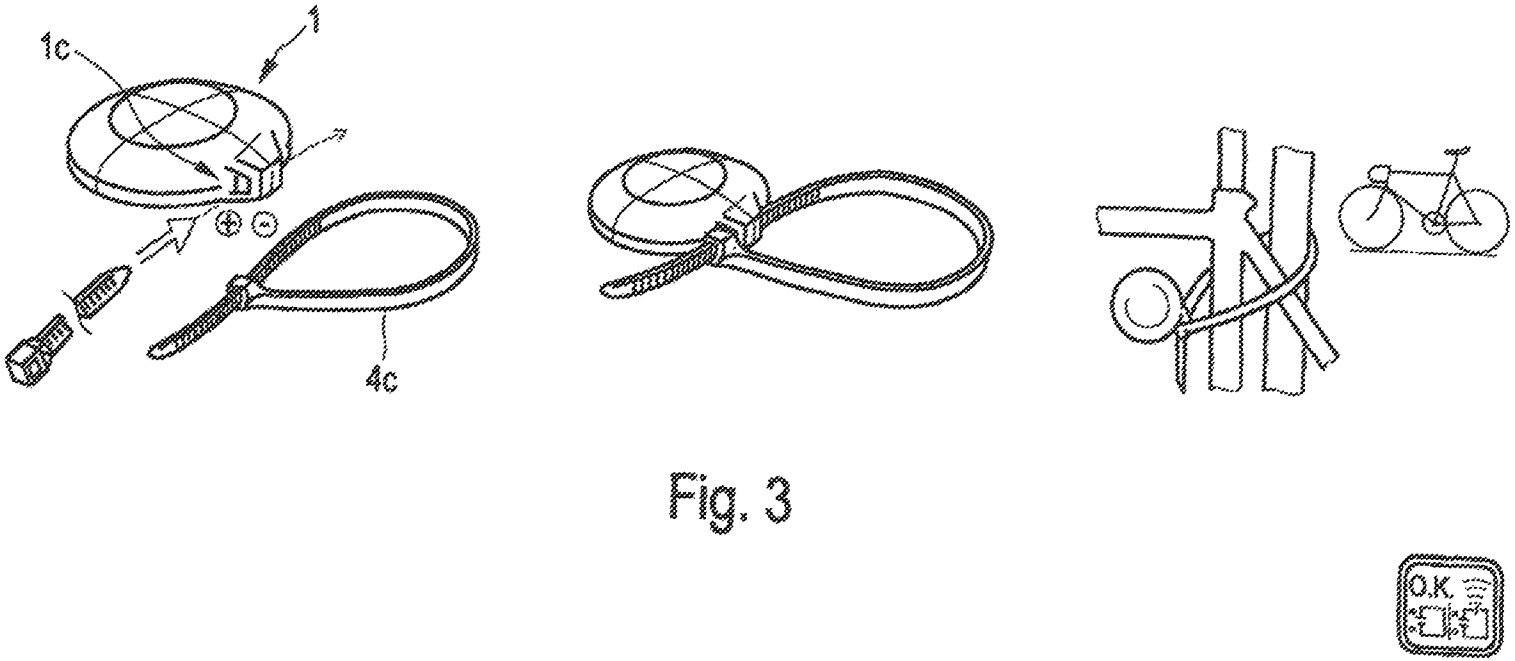
FIG. 3 shows the application of an alarm emitter 1 in connection with a sensor element 4*c* from FIG. 1.

FIG. 3 shows the application of an alarm emitter 1 in connection with a sensor element 4*c* from FIG. 1, in this case in the form of a cable tie. The left side of FIG. 3 illustrates that the alarm emitter 1 may comprise an opening 1*c* through which a sensor element 4*c* can be inserted into the alarm emitter 1, electrical contacts being provided in the opening so as to achieve an electrical connection to at least one electrical line arranged in the sensor element 4*c*. As stated above, these may be surface contacts or else piercing contacts.

The open end of the sensor element 4*c* which is introduced through the opening 1*c* can be guided in a loop so as to form, through the eye of the sensor element 4*c*, a closed loop which cannot be opened again as a result of the functionality known from a cable tie, since there is a one-way locking connection between the open end and the eye of the sensor element 4*c*, which merely makes it possible to make the formed loop smaller.

The right side of FIG. 3 shows that for example a bicycle frame can be secured to a mast using a sensor element of this type, which is formed into a loop and which is also guided through or into the opening 1*c* of the emitter 1 inside the formed loop or at the open end so as to form a checkable electrical circuit. The bicycle can thus only be removed from the mast when the sensor element 4*c* is cut, and this also causes the electrical circuit to be cut, and this is detected and signalled by the alarm emitter if it has not previously been deactivated.

Figure 4:
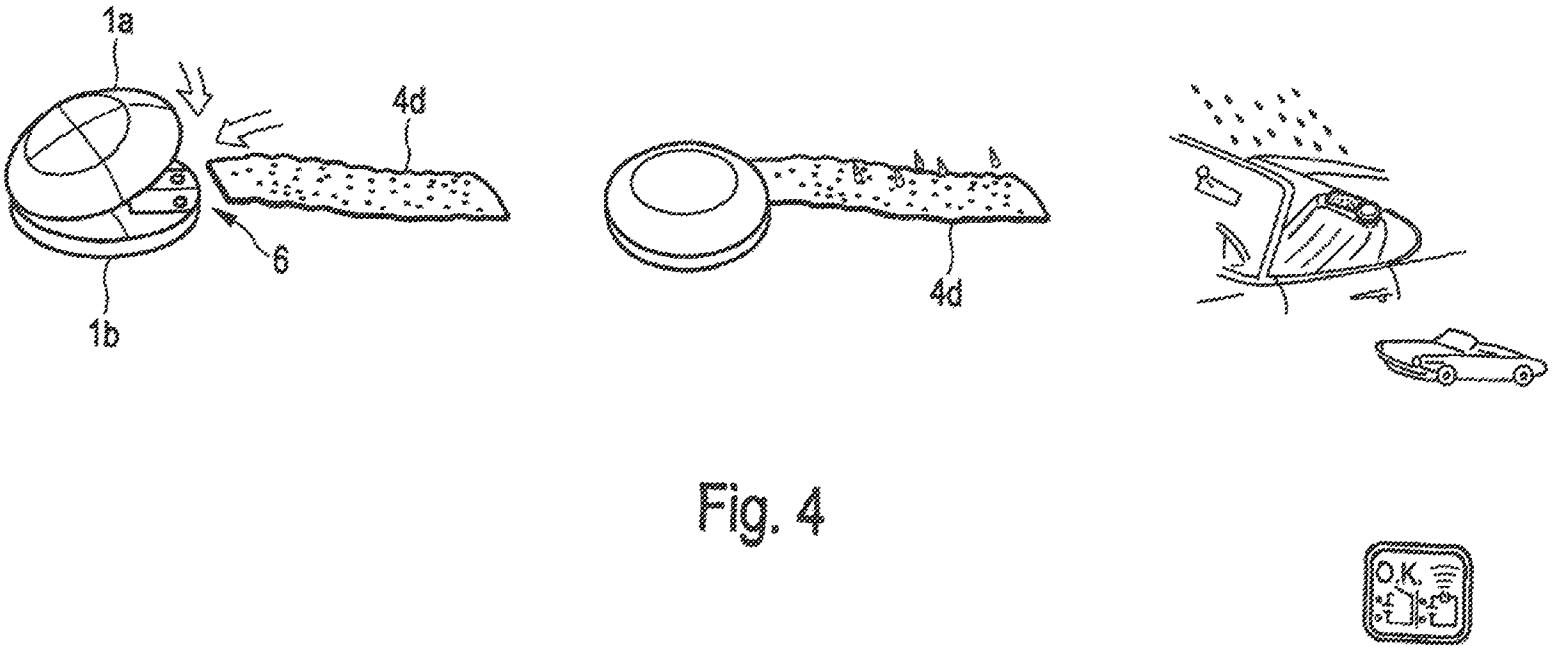
FIG. 4 illustrates another embodiment of sensor elements.

FIG. 4 illustrates another embodiment of sensor elements which are not shown in FIG. 1. These may for example be sensor elements 4*d* which change in resistance or other electrical properties in moisture such as occurs for example in the event of rain.

In this case it is provided, as described for FIG. 2, to introduce an end of a moisture-sensitive or generally weather-sensitive sensor element between the two housing parts 1*a* and 1*b* of the alarm emitter in the receiving region 6 and thus to achieve an electrical connection between the alarm emitter and the sensor element 4*d*.

If rain hits the sensor element 4*d*, this changes the electrical property thereof, for example the resistance, and this can be established by the alarm emitter by way of the electrical connection to said alarm emitter, after which said emitter signals an alarm, for example optically, acoustically or by telecommunication.

The drawing on the right of FIG. 4 illustrates a possible application, specifically by way of example securing a convertible which is parked in the open, for which purpose an alarm device according to the invention of this type is positioned on the car seat, and subsequently reliably detects when it starts to rain and makes the user aware of this situation for example by way of a text message or another form of telecommunication, even if the user is far away from the car which is parked in the open, for example in a house, where they do not notice the onset of the rain.

Figure 5:
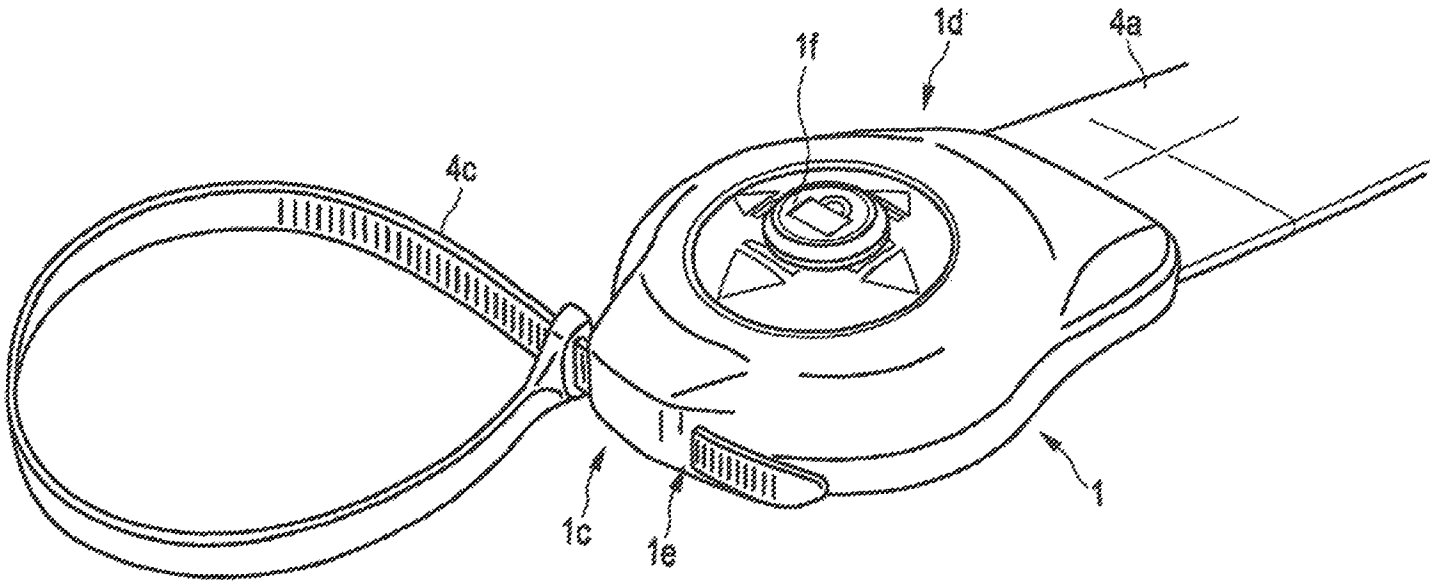
FIG. 5 shows an embodiment in which two receiving regions are provided on the alarm emitter for sensor elements of different types.

FIG. 5 shows an embodiment in which two receiving regions are provided on the alarm emitter for sensor elements of different types, specifically a region 1*c* for receiving an open end of a sensor element formed as a cable tie or another sensor element 4*c* formed in a strip shape, for which purpose it is for example simply inserted into this receiving region or the opening thereof.

In this case, a receiving region 1*d* is provided opposite the receiving region 1*c* and is used to receive and contact a sensor element 4*a* formed for example as an adhesive strip. For this purpose, a folding axis 1*e* may be provided, which is positioned in the region 1*c* and about which the alarm emitter can be opened, as is also shown in FIG. 2.

Without any limitation to this embodiment, FIG. 5 also shows that the alarm emitter 1 may comprise, in this case on the surface thereof, a key 1*f* for operation, for example for activating or for operating the mechanical fastening of a sensor element, for example to cause a receiving region to open.

Figure 6:
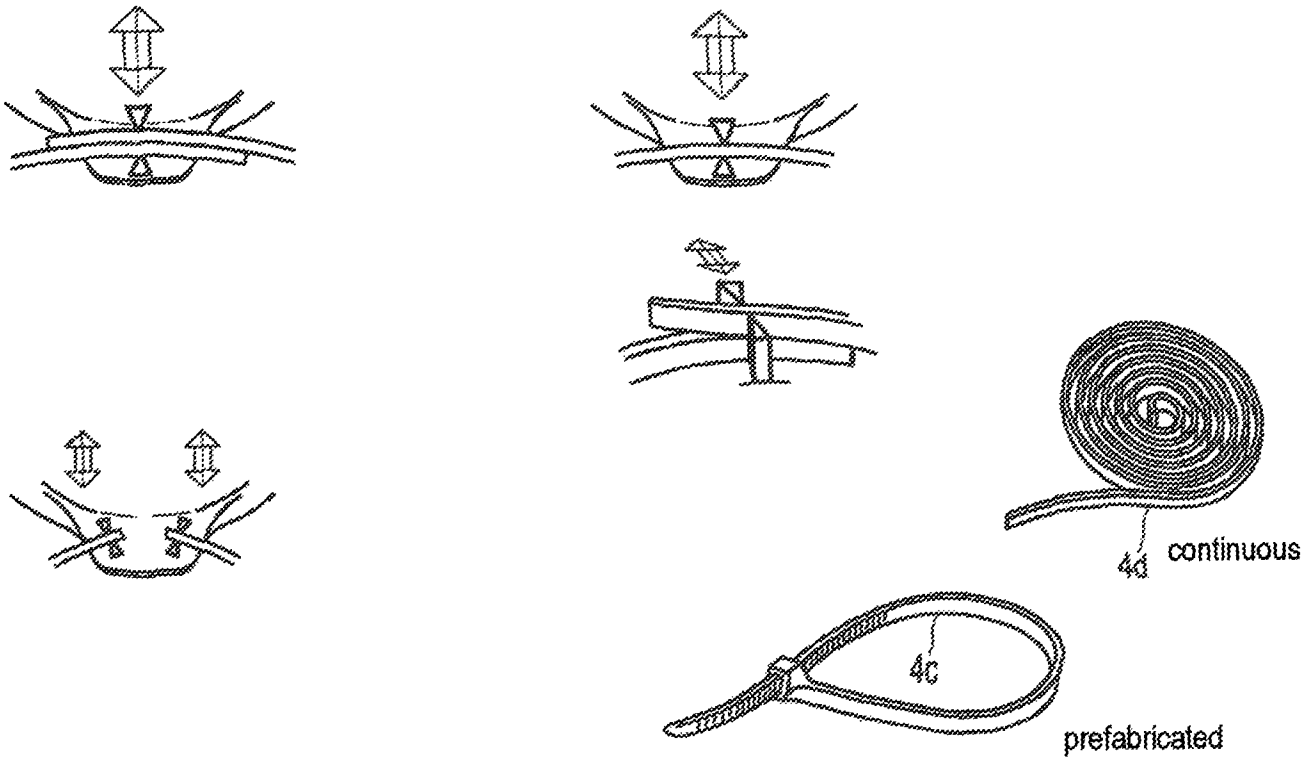
FIG. 6 shows by way of example a plurality of electrical and/or mechanical connection options between a preferably strip-shaped sensor element and an alarm emitter.

FIG. 6 shows by way of example a plurality of electrical and/or mechanical connection options between a preferably strip-shaped sensor element and an alarm emitter. The sensor element may for example be formed as a cable tie or else as a continuous strip from which a desired length is cut.

The drawings in FIG. 6 illustrate that, in the receiving region for a strip-shaped sensor element of this type, for example the strip ends of a sensor element may be arranged so as to cover/overlap one another for example in the radial direction (top left) or may be arranged one on top of the other in the width of the strip (top right) or separate reception or contact may be provided for each strip end (bottom left). In this context, for example in each case the sensor element or a strip end thereof may be gripped between two contacts which are arranged so as to be mutually opposing and thus be both electrically contacted and mechanically fastened.

The aforementioned embodiments illustrate that an alarm device according to the invention opens up a large number of fields of use and can be produced cost-effectively, since the alarm emitter 1 forms a unit which is always reusable, and which can be used by a user with optionally different sensor elements so as to cover various applications or fields of use.

In this case, it is considered to be an advantage that the individual sensor elements can be drawn from a reserve of units or from a continuous reserve, in particular a strip reserve, in such a way that the possibility is provided of offering sensor elements of this type as a separate commercial product for alarm devices according to the invention on the market.

According to the invention, sensor elements of this type are initially used up as a result of the use thereof and thus always required again when a previously protected or secured article is to be unsecured and secured again or when an alarm situation has led to the destruction of the sensor element. This is the case for example in the application of FIG. 4, in which a moisture-sensitive sensor element is used. When this has become wet, it has changed the electrical property thereof, displays the alarm situation and cannot subsequently be used again to display the same event.

Accordingly, a new, dry sensor element 4*d* is required for securing another article or for securing the same article again.

In relation to the application example of FIG. 2, it may additionally be provided that a strip, which is formed as a sensor element which is adhesive at least on one side, is produced in such a way that once it has been adhesively fastened it is not possible to pull this sensor element off the secured article without changing the electrical property of this sensor element. This does not necessarily mean that the adhesive matrix material which encloses the electrical conductor has to be torn apart, but rather an embodiment may be designed in such a way that when the adhesive strip is pulled off, the resulting forces tear apart at least the conductors 5 which are arranged in the adhesive strip or on the surface thereof.

Thus, the structural constitution of the sensor element which is configured as an adhesive strip provides that it is a single-use product of the sensor element, which can only be used once for securing an article.

In the embodiments in FIG. 3, in which a sensor element is configured with the functionality or the design of a cable tie, the single-use property is also evident, since the one-way locking of the open end in the eye of the sensor element means that once the loop of the sensor element 4*c* has been formed it cannot be opened without cutting this sensor element apart.

Thus, in this case too, the design property of the sensor element provides the single-use functionality. Accordingly, it can generally be provided for any type of sensor elements that they are of a mechanical configuration such that after use or after the used sensor element is released or removed from the secured article further use is not possible, since removal is preferably only possible by destroying the sensor element or at least permanently changing the electrical property thereof.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. An alarm device, comprising:

a portable alarm emitter; and a sensor element connected to the alarm emitter;

wherein the portable alarm emitter is configured to detect a change in an electrical property of the sensor element and to signal an alarm if a change is established;

wherein the portable alarm emitter and the sensor element are separate units configured to be interconnected with electrical contact;

wherein the portable alarm emitter is a reusable unit and the sensor element is also as reusable unit;

wherein the sensor element has a first end which is formed as an eye, through which a second end of the sensor element can be passed in order to form a closed loop which can only be made smaller because of a one-way locking function of the eye, the sensor element having at least one line element which can be contacted after the other end is introduced into the alarm emitter; and wherein the portable alarm emitter is releasably connected to the second end of the sensor element at a portion of the sensor element outside of the closed loop.

2. The alarm device according to claim 1, wherein the sensor element is configured with the mechanical design of a cable tie.

3. The alarm device according to claim 1, wherein the sensor element is used up by the process of securing and unsecuring an article to be protected.

4. The alarm device according to claim 1, further comprising:

at least one reserve of sensor elements from which or of which at least a single sensor element can be taken or connection to the portable alarm emitter.

5. The alarm device according to claim 4, wherein a reserve of sensor elements is formed using a plurality of identical individual sensor elements.

6. The alarm device according to claim 1, wherein the sensor element is formed so as to be strip-shaped with at least one electrical line which can be electrically contacted by the portable alarm emitter, which extends along the longitudinal extension of the strip-shaped sensor element, which is enclosed by the material of the sensor element, and which can be electrically contacted by the portable alarm emitter at at least one end of the sensor element or which extends on at least one surface of the sensor element.

7. The alarm device according to claim 1, the portable alarm emitter comprises at least one receiving region in which the sensor element can be connected to the portable alarm emitter with electrical contact.

8. The alarm device according to claim 7, wherein the portable alarm emitter comprises at least two receiving regions which are configured to connect to different sensor elements of different types.

9. The alarm device according to claim 7, wherein a receiving region is:

formed as an opening, into which at least one end of the sensor element can be inserted to produce a connection with electrical contact, or formed as an insertion region, which is formed between two housing parts of the portable alarm emitter which are pivotable with respect to one another, and into which at least one end of a sensor element can be inserted after pivoting open the housing parts, and which is electrically contactable by pivoting closed.

10. The alarm device according to claim 1, wherein the portable alarm emitter comprises a communication module configured to send a message signalling an alarm to a mobile telephone if the alarm is triggered.

11. The alarm device according to claim 10, wherein the portable alarm emitter is configured to be deactivated by a message communicated to the portable alarm emitter and received by the communication module.

12. The alarm device according to claim 10, wherein the portable alarm emitter is configured to facilitate sending and/or receiving messages via the communication module for a limited time period or a limited number of communications, and to extend the time period or increase the number.

13. The alarm device according to claim 1, wherein the portable alarm emitter comprises at least one actuation element configured to activate the portable alarm emitter, wherein the at least one actuation element comprises at least one key.

14. The alarm device according to claim 1, wherein the portable alarm emitter comprises, on a surface thereof, at least one illumination device configured to optically signal an alarm, to display an optical confirmation to confirm an activation or deactivation action, and to provide continuous or intermittent illumination.

* * * * *